United States Patent [19]

Hastings et al.

[11] Patent Number: 4,576,827

[45] Date of Patent: Mar. 18, 1986

[54] ELECTROSTATIC SPRAY COATING SYSTEM

[75] Inventors: Donald R. Hastings, Elyria; John Sharpless, Oberlin, both of Ohio

[73] Assignee: Nordson Corporation, Amherst, Ohio

[21] Appl. No.: 602,974

[22] Filed: Apr. 23, 1984

[51] Int. Cl.[4] ..... B05D 4/04; H01C 13/00

[52] U.S. Cl. ..... 427/27; 428/367; 428/375; 428/392; 361/225; 361/227; 338/214; 239/3; 239/690; 239/691; 239/706

[58] Field of Search ..... 428/367, 375, 392; 361/225, 227; 338/214; 427/27; 239/3, 690, 691, 706

[56] References Cited

U.S. PATENT DOCUMENTS

| | | | |
|---|---|---|---|
| 2,861,163 | 11/1958 | Asakawa | 338/214 |
| 2,926,106 | 2/1960 | Gauthier | 239/700 |
| 2,989,241 | 6/1961 | Badger | 239/700 |
| 3,167,255 | 1/1965 | Point et al. | 239/690 |
| 3,792,409 | 2/1974 | Smart et al. | 338/214 |
| 3,859,506 | 1/1975 | Weckstein | 338/214 |
| 4,100,233 | 7/1978 | Yajima et al. | 423/345 |
| 4,103,276 | 7/1978 | Kennon et al. | 338/214 |
| 4,357,526 | 10/1982 | Yamamoto et al. . | |
| 4,369,423 | 9/1969 | Holtzberg | 338/214 |
| 4,373,006 | 2/1983 | Galasso et al. | 428/368 |
| 4,426,568 | 1/1984 | Kato et al. . | |
| 4,443,361 | 4/1984 | Hierholzer, Jr. et al. . | |

OTHER PUBLICATIONS

Nippon Carbon Co., Ltd., High Tensile Strength, Heat Resistant Continuous Silicon Carbide Fiber, NICALON.

Nippon Carbon Co., Ltd., NICALON Silicon Carbide Continuous Fiber.

Dow Corning Corporation, Dow Corning Spec. Sheet.

*Primary Examiner*—Richard Bueker

*Attorney, Agent, or Firm*—Wood, Herron & Evans

[57] ABSTRACT

An electrostatic spray system including a spray device having a coating-charging electrode, a source of high voltage electrostatic potential, and a resistive path for safely transmitting high voltage between the electrode and the electrostatic supply. The resistive high voltage transmission path is composed of plural parallel-connected continuous silicon carbide fibers.

57 Claims, 10 Drawing Figures

ELECTROSTATIC SPRAY COATING SYSTEM

FIELD OF THE INVENTION

This invention relates to electrostatic spray coating systems employing spray devices or guns having a high voltage electrode for charging the coating material to be sprayed, and more particularly, to an improved electrostatic spray coating system of the type which, for the purpose of minimizing shock and ignition hazard due to inadvertent discharge of electrical energy capacitively stored in the system, incorporates resistance in the electrode-energizing path in the gun and/or in the high voltage cable which interconnects the gun and a remote high voltage electrostatic power supply.

BACKGROUND OF THE INVENTION

In electrostatic spray coating systems of the type to which this invention relates, coating particles are emitted from a spray device, often called a "gun", toward an object to be coated. The coating particles may be in the form of powder transported to the spray device in a fluid stream such as air, or in the form of liquid such as paint, varnish, lacquer, or the like which has been atomized by the spray device utilizing conventional air atomization, hydraulic atomization ("airless"), and/or rotary atomization principles. Associated with the spray device are one or more electrodes which cause the particles emitted by the spray device to carry an electrostatic charge such that when the charged particles are propelled by the spray device toward an article to be coated, which is maintained at an electrostatic potential different than that of the charged coating particles, the coating particles will be deposited on the article with improved efficiency, coverage, and the like. Depending upon the particular construction of the spray device and its associated electrode(s), the electrical charge transfer mechanism may involve contact charging, corona charging, inductive charging, and/or ionization, etc. in accordance with charging principles which are well known in the electrostatic coating field.

Also associated with the spray device is a high voltage electrostatic supply for providing electrostatic potentials of approximately 50 KV or more to the charging electrode. The high voltage electrostatic supply may be remotely located with respect to the spray device, in which event an electrical cable insulated for high voltage is connected between the spray device and the remote power supply. Illustrative electrostatic liquid spray coating systems of this type are disclosed in Juvinall U.S. Pat. No. 3,367,578 (rotary atomization), Hastings U.S. Pat. No. 4,335,851 (air atomization), and Wilhelm et al U.S. Pat. No. 3,870,233 and Hastings et al U.S. Pat. No. 4,355,764 (hydraulic atomization). A powder spray device supplied from a remote high voltage supply is shown in Duncan et al U.S. Pat. No. 3,746,254. In other known electrostatic spray coating systems, the high voltage electrostatic supply is mounted to and/or incorporated in the spray device, in which case electrical energy is transmitted to the spray device from a remote low voltage source via an electrical cable which need only be insulated for safe operation at low voltage. Illustrative of systems of this latter type are those disclosed in Senay U.S. Pat. No. 3,731,145, Buschor U.S. Pat. No. 3,608,823, Skidmore U.S. Pat. No. 3,599,038, Huber U.S. Pat. No. 4,323,947, and Bentley et al U.S. Pat. No. 4,331,298.

In electrostatic spray coating systems electrical energy is capacitively stored in the electrical path which supplies charging potential to the electrode. Included in this charge-conducting path are components of the high voltage electrostatic supply, interconnecting high voltage cables, and electrical switches, contacts, conductors, and the like. In addition, electrical energy is capacitively stored in the spray device itself as a consequence of the presence of structural elements of an electrically conductive nature which function in much the same manner as plates of a capacitor. The electrical energy stored in capacitive form is proportional to the quantity $\frac{1}{2}CV^2$, where C is capacitance and V is voltage. Should the capacitively stored energy be rapidly discharged, such as, if the electrode is inadvertently electrically grounded or brought in close proximity to an electrically grounded object, a spark can result having sufficient energy to cause ignition in the environment surrounding the spray device which is often explosive due to the presence of volatile coating solvents and/or combustible concentrations of coating powder. Additionally, inadvertent discharge of electrically stored energy can create shock hazards to personnel who come in contact with the charging electrode.

To reduce the rate of discharge of capacitively stored energy in the foregoing situations to safe limits, it has been the practice to connect one or more discrete resistors in the high voltage path which interconnects the charging electrode and the high voltage electrostatic supply. Typically, there is at least one rather large resistor (for example, 75M ohms), and in some cases also a second resistor of lesser value (10M–20M ohms), incorporated in the high voltage path in the spray device or gun upstream of the electrode, with the lesser value resistor preferably being connected directly to the electrode. Illustrative of patents disclosing one or more gun-mounted resistors are Kennon U.S. Pat. No. 4,182,490, and Hastings U.S. Pat. No. 4,335,851, which each disclose a relatively small and a relatively large resistor incorporated in the gun in the electrical path between the electrode and the high voltage cable which connects the spray gun to a remote high voltage electrostatic supply. Illustrative of a single resistor in a gun in the electrical path between the electrode and a high voltage electrostatic supply, also located in the gun, is Skidmore U.S. Pat. No. 3,599,038. Electrostatic coating systems of the rotary atomization type also incorporate discrete resistors in the spray device.

In addition, and in those electrostatic spray coating systems utilizing remotely located high voltage electrostatic supplies, a plurality of discrete resistors are serially connected in the high voltage cable interconnecting the spray gun and the remote high voltage electrostatic supply. Typically, the total resistance of the plural series-connected discrete resistors of the high voltage cable is on the order of approximately two hundred million (200M) ohms. Accordingly, if a cable having a length of eight meters is provided with discrete resistors every one meter of length, each cable resistor will have a value of approximately 25M ohms. Illustrative of one form of high voltage cable incorporating a plurality of series-connected discrete resistors is the cable disclosed in Nord U.S. Pat. No. 3,348,186.

The utilization of discrete resistors, particularly in high voltage cables, has a number of very serious shortcomings. For example, an important disadvantage involves the unreliability, both electrically and mechanically, of discrete resistor high voltage cables, which leads to unpredictable and premature failure. There are a number of causes of this unreliability, including heat dissipation from the resistors which can melt the polyethylene insulation which has a melting point of 200° F., as well as degrade the resistor which also occurs at temperatures of 200° F. or less. Additionally, discrete resistor high voltage cables are not resistant to solvent attack, causing premature failure, and are relatively stiff and bulky, leading to operator fatigue when used with spray devices of the hand-held or manual type.

Another disadvantage of discrete resistor cables is high initial cost due to the relatively high cost of high voltage resistors and the relatively complex assembly process required to electrically and structurally interconnect the series-connected high voltage resistors in the cable. In terms of assembly, the assembly process in one form includes, among other steps, placement of the axial leads of adjacent resistors into conductive vinyl tubes which are used to both physically space and electrically connect adjacent resistors, which is a rather time consuming operation. As for cost, high voltage resistors are themselves quite expensive. The utilization of conductive vinyl tubes into which the resistor leads are inserted are undesirable for a further reason, namely, they cooperate to form a coaxial capacitor giving rise to a still further source of unwanted capacitive electrical energy storage.

Another disadvantage of discrete resistor cables is that while operative in the range of 50 KV–125 KV, they are generally inoperative, at least for extended periods of time, at voltages of 150 KV or more.

High voltage resistors incorporated in the gun, while not as troublesome as discrete resistor cables, nevertheless suffer from a number of the same disadvantages, such as, relatively high cost, inadequate resistance to solvent attack, premature failure, and the like.

In an effort to overcome the problems inherent in discrete resistor high voltage cables, it has been proposed to utilize a high voltage cable having a core fabricated of electrically conductive particles, such as, carbon or graphite granules, distributed within or coated upon a nonconductive material, such as, synthetic or natural rubber. An arrangement of this type is proposed in Point U.S. Pat. No. 3,167,255. The difficulty with this proposal is that the conductivity of the cable core is dependent upon, among other things, surface contact between the conductive particles in the nonconductive matrix, which in turn depends upon the shape and size of the particles as well as the degree to which the particles are uniformly distributed throughout the matrix. Since these variables are extremely difficult to control, it has been found to be virtually impossible to control the resistivity of the cable core within desired limits. Additionally, as the cable is flexed, the conductive particles physically move relative to each other, adversely affecting the conductivity provided by the surface contact between adjacent conductive particles.

A further disadvantage is that the resistivity of the cable core is extremely dependent upon the percentage content of the conductive particles in the nonconductive matrix, with very slight increases in percentage content of conductive particles giving rise to dramatic reductions in resistivity. Since it is virtually impossible to control the percentage content of the conductive particles with the precision required, the resistivity of the cable core is highly erratic from cable to cable and/or from one section to another within the same cable.

Proposals for conductive particle-type resistive elements, although not for use in high voltage cables for electrostatic spray coating systems, are contained in Asakawa U.S. Pat. No. 2,861,163, Weckstein U.S. Pat. No. 3,859,506, French Pat. No. 983753. Asakawa proposes a heating element having conductive carbon black particles distributed in nonconductive material, such as, paraffin, polyethylene, etc. Weckstein proposes a heating cable having several layers of different type material, one layer of which includes "high resistance conductive" yarn in the form of "electrically conductive strands of fiberglass or quartz subjected to milimicron-size particles of a highly conductive material in a colloidal suspension". Illustrative of colloidal particles which are proposed are those of "graphite, silicon carbon, and other semiconducting materials". The French patent also appears to refer to the use of silicon carbide powder as an impregnating material in an otherwise nonconducting fiber core of an ignition cable. For the reasons noted in connection with Point U.S. Pat. No. 3,167,255, namely, reliance upon conductive particulate material in an insulative matrix, the proposals of the foregoing patents suffer the noted disadvantages of resistance change with flexion, inability to control resistivity, etc. which are inherent in "conductive particle" type cables.

Holtzberg U.S. Pat. No. 4,369,423 proposes an electrically conductive automotive ignition cable which has a core comprising a plurality of mechanically and electrically continuous filaments of graphitized polyacrylonitrile. The Holtzberg graphitized polyacrylonitrile filament automotive ignition cable has a resistance of approximately 200 ohms per lineal meter. While a resistance per lineal meter of this magnitude is presumably acceptable in the Holtzberg application where the objective is to provide reduced RF disturbance and resistance in an automotive ignition cable, it is totally inoperative for use as a high voltage cable in an electrostatic spray coating system where a resistance per lineal meter of approximately 30M ($30 \times 10^6$) ohms is typically necessary. As used herein, the numeric abbreviation M is defined to equal $10^6$.

SUMMARY OF THE INVENTION

It has been one of the principal objectives of this invention to provide an improved electrostatic spray coating system incorporating resistance in the high voltage path interconnecting the high voltage electrostatic supply and the charging electrode, which is mechanically and electrically reliable, exhibits a resistance which is independent of cable flexure, and is capable of satisfactory operation at very high voltages, for example, 150 KV or more.

It has been a further and equally important objective of this invention to provide a highly flexible, rugged, and thermally and chemically resistant high voltage cable of easily controlled resistivity incorporating relatively high resistance uniformly distributed along the length thereof which is not prone to premature failure when operated at relatively high voltage and which is not unduly costly from the standpoint of materials and/or assembly.

It has been a still further objective of this invention to provide an electrostatic spray device or gun incorporating a discrete resistor connected in the high voltage path to the electrode which is rugged, reliable, and relatively low in cost.

The foregoing and other objectives and advantages are achieved in accordance with certain of the principles of this invention by incorporating, in the high voltage path between the high voltage electrostatic supply and the charging electrode, a plurality of continuous silicon carbide fibers electrically connected in parallel having the physical and electrical characteristics of NICALON fiber of the general type disclosed in U.S. Pat. No. 4,100,233 and commercially available from Nippon Carbon Co., Ltd., Tokyo, Japan and Dow Corning, Midland, Mich. In a preferred embodiment the silicon carbide fibers are heat treated to provide a specific resistivity in the approximately $1\times10^3$ ohm-cm., and a fiber diameter in the approximate range of 10–15 microns. Continuous silicon carbide fibers of the foregoing types exhibit substantial flexibility, high tensile strength, corrosion and heat resistance, uniformity in resistivity, and yet are very low in cost per lineal foot.

In a preferred form of the invention, the continuous silicon carbide fibers are combined to form a yarn around which a high voltage insulative sheath is provided, such as extruded polyethylene, producing a flexible high voltage cable. With four strands of 500-filament yarn connected in parallel to form a multi-yarn high voltage cable core, an insulated high voltage cable having approximately 25M ohms per lineal meter which, when made into an 8 meter cable, produces a total cable resistance of approximately 200M ohms. The foregoing assumes a specific resistivity of $1\times10^3$ ohm-cm. and an average filament or fiber diameter of approximately 11 microns. The four 500-filament strands of yarn connected in parallel result in a cable core having a total diameter of 0.035 cm.

An electrostatic spray coating system incorporating a high voltage cable of the foregoing type was found to be free of ignition hazards when the high voltage cable was intentionally severed in a standard ignition test environment with the high voltage supply in an energized condition. Thus, electrostatic coating systems utilizing high voltage cables constructed in accordance with the principles of this invention are extremely safe, as well as being low in cost and exhibiting flexibility, ruggedness, and resistance to high temperature and corrosion.

In accordance with a further preferred embodiment of the invention, a gun of the type which incorporates resistance in the gun connected to the electrode is provided with gun resistance in the form of parallel-connected continuous silicon carbide fibers connected to the electrode of sufficient number, resistivity, length, and diameter to provide the desired gun resistance.

In a further preferred embodiment of the invention designed for use with a remote high voltage electrostatic supply, a system of the type incorporating both gun and cable resistance is provided in which the cable and gun resistance collectively takes the form of a single multi-filament cable of parallel-connected continuous silicon carbide fibers sufficient in number that, taking into account the specific resistivity and diameter thereof, produce a total resistance in the multi-hundred megohm range between the gun electrode and the remote high voltage electrostatic supply. An important advantage of this embodiment is that there is no mechanical joint between the cable and gun resistor which often is characterized by sharp edges which give rise to corona discharge and attendant dielectric breakdown of the insulation in the gun wall proximate the mechanical connection. Additionally, there is no need for applying dielectric grease to the connection between the resistor and cable since there is no connection.

In accordance with a still further preferred embodiment of the invention, a system of the type in which a high voltage electrostatic supply is incorporated in the gun and the output thereof connected to the charging electrode via a high resistance path, the high resistance path between the gun-mounted high voltage supply and the electrode is provided in the form of a multi-strand continuous silicon carbide fiber cable connected between the electrode and output of the high voltage supply which, taking into account the number, diameter, and resistivity of the specific continuous silicon carbide fibers, provides a total resistance in the 100M ohm range.

In accordance with a still further preferred embodiment of the invention, a system of the type employing rotary atomization is provided which includes a rotating atomizer fabricated of insulative material having a ring-shaped charging electrode embedded therein proximate the atomizing edge thereof, which electrode ring is in the form of a group of parallel-connected continuous silicon carbide fibers. High voltage electrostatic energy is transmitted from a voltage supply to the charging ring-shaped electrode embedded in the rotating atomizing member via an electrical path which principally comprises parallel-connected continuous silicon carbide fibers which collectively constitute a resistance in the multi-hundred megohm range between the silicon carbide fiber charging electrode mounted in the rotary atomizer and the high voltage electrostatic supply.

These and other features, advantages, and objectives of the invention will become more readily apparent from a detailed description thereof taken in conjunction with the figures in which:

FIG. 1A is a side elevational view in cross section of an air atomization spray gun utilizing a continuous silicon carbide fiber high voltage cable constructed in accordance with this invention for interconnecting a remote high voltage electrostatic supply and a conventional discrete high voltage resistor incorporated in the gun which connects to the electrode via a conventional discrete high voltage resistor of lesser value.

Figure 5:
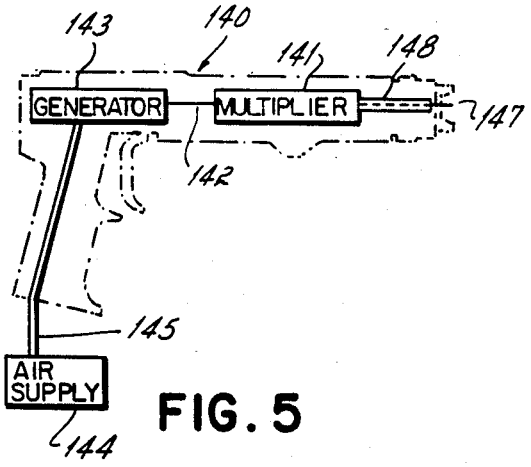

FIG. 5 is a schematic view of an air atomization and/or hydraulic atomization gun schematically illustrating a continuous silicon carbide fiber resistor of this invention connected between the electrode and a high voltage electrostatic supply incorporated in the gun which is energized via an air-driven turboelectric generator, also mounted in the gun, which is connected to a remote air supply via an air hose.

Figure 6:
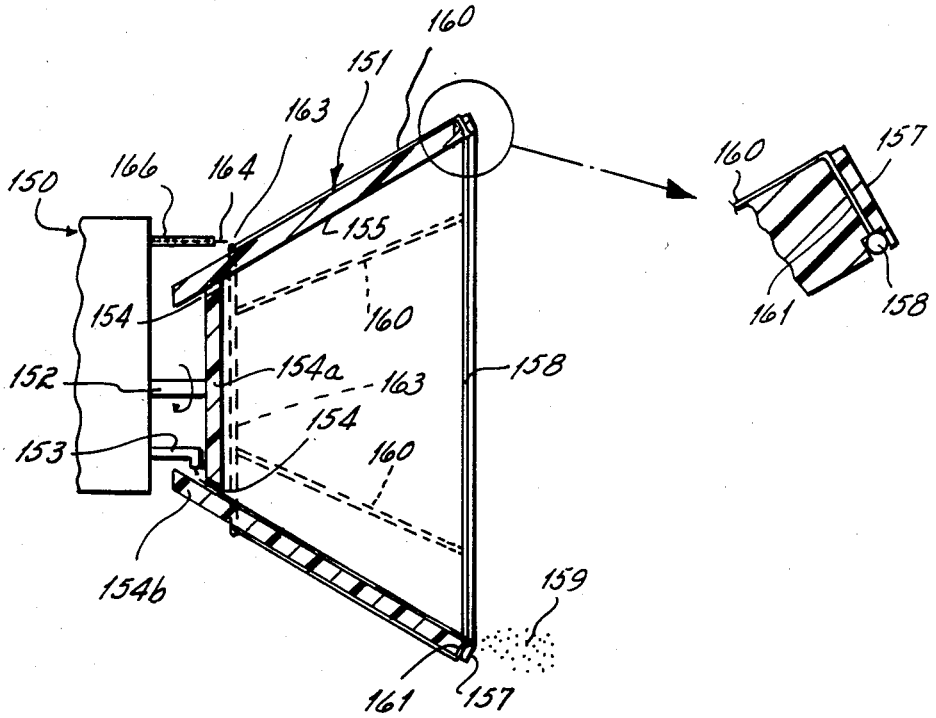

FIG. 6 is a schematic view of a rotary atomizing spray device schematically illustrating a ring-shaped continuous silicon carbide fiber electrode of this invention mounted for rotation with a rotating atomizing cup which is connected to a high voltage electrostatic supply via a continuous silicon carbide fiber resistive path of this invention.

Figure 7:
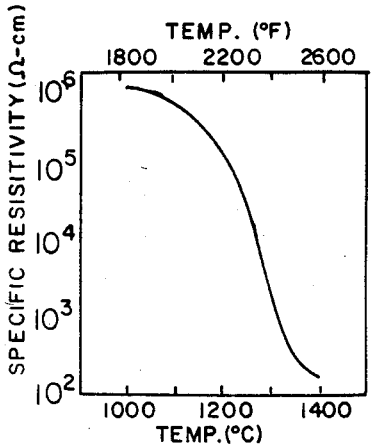

FIG. 7 is a plot of specific resistivity versus heat treating temperature for the continuous silicon carbide fiber resistive core of this invention.

Figure 8:
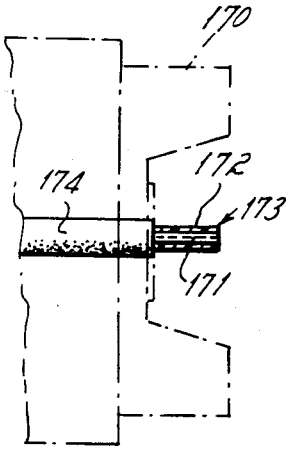

FIG. 8 is a schematic view of an air atomization and/or hydraulic atomization gun schematically illustrating an electrode fabricated of continuous silicon carbide fibers of this invention which is reinforced with a relatively rigid electrically conductive resin sheath.

Figure 9:
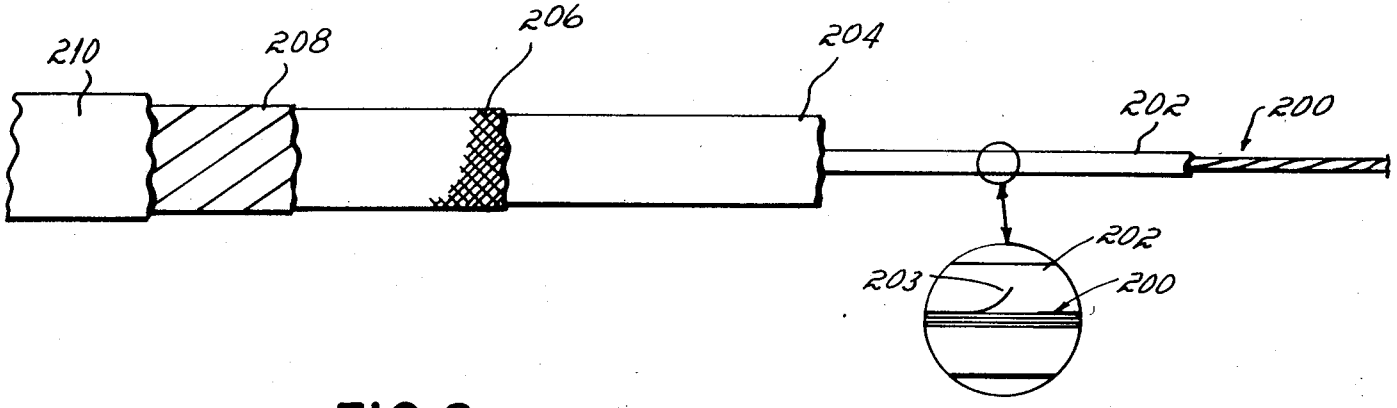

FIG. 9 is a front elevational view, partially cut-away, showing the various elements of a preferred cable.

Figure 1:
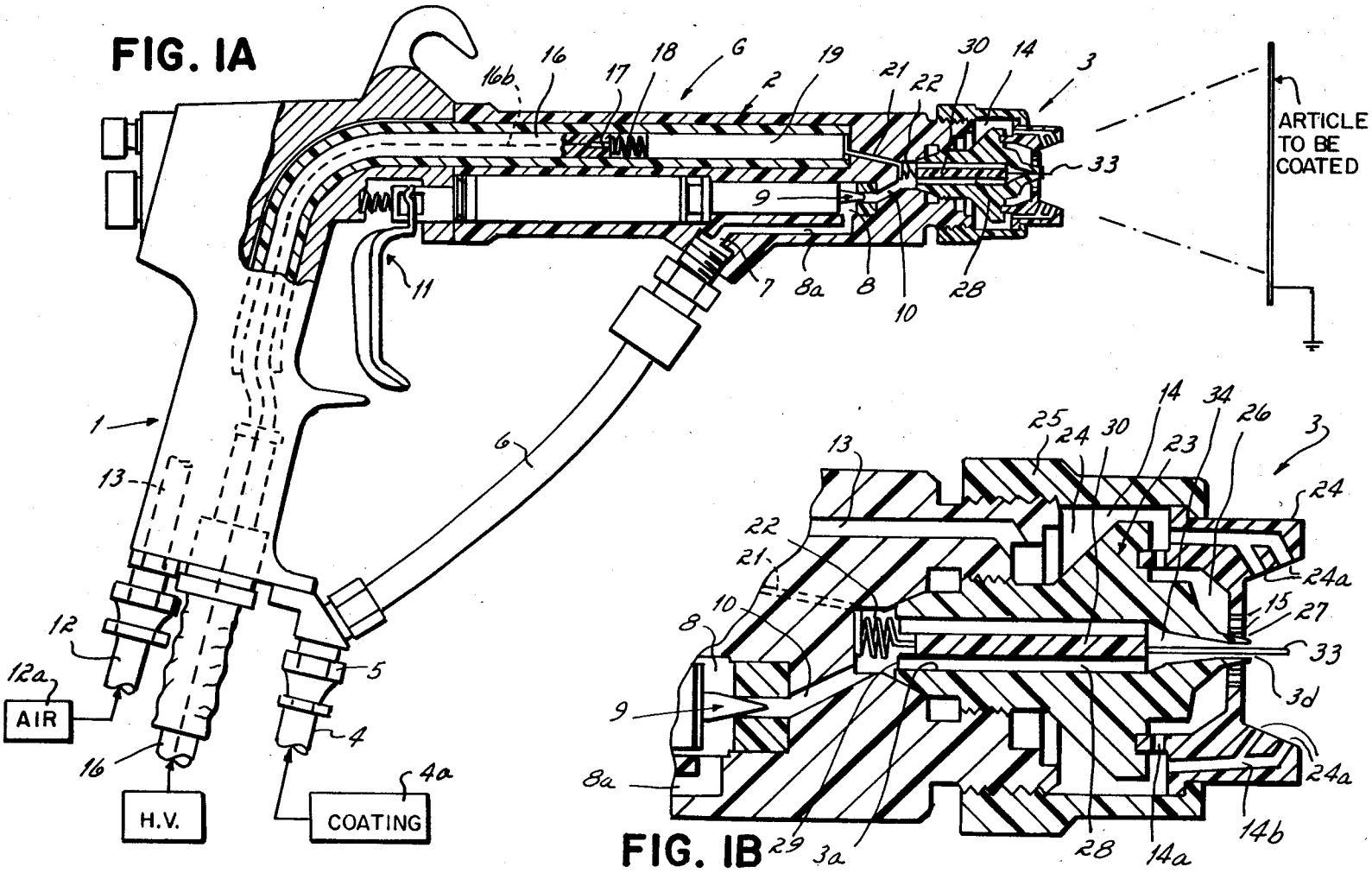
FIG. 1B is an enlarged view of the nozzle portion of the gun shown in FIG. 1A.

With reference to FIG. 1A, a preferred embodiment of an electrostatic spray coating system incorporating this invention is depicted in conjunction with an air atomization spray device or gun G. The general construction of the gun is not critical and can take a wide variety of forms, such as like that described in Hastings U.S. Pat. No. 4,335,851, the disclosure of which is incorporated herein by reference. The gun G includes a metallic, electrically grounded handle 1 to which is attached an electrically nonconductive barrel 2. A nozzle 3 is located at the forward end of the barrel 2. Included in the system for supplying coating material to the gun G is a hydraulic hose 4 and a pressurized source of coating material 4*a*. The hose 4 is connected to a fitting 5 secured to the butt end of the handle 1 which has a fluid passage therethrough to interconnect the hose 4 with a section of hose 6 connected between the fitting 5 and an inlet passage 7 in the side of the barrel 2. The inlet passage 7 communicates with a first fluid passage 8 located in the barrel 2 via a passage 8*a*. A needle and seat valve assembly 9 located in the fluid passage 8 is effective to control the flow of fluid from the passage 8*a* to a fluid passage 10. The fluid passage 10 is adapted to be connected to a fluid passage 28 in the nozzle 3. A trigger assembly 11 is effective to operate the needle and seat valve assembly 9.

Also included in the system for supplying air to the gun G is a source of pressurized air 12*a* and an air hose 12 connected between the source of pressurized air and a passage 13 in the handle of the gun. The air passage 13 connects through a path (not shown in FIG. 1A) with an air chamber 14 in the nozzle 3 of the gun. The air in chamber 14, in a manner well known to those skilled in the art, is directed through suitable passages, described hereafter, to impinge upon the stream of coating material for the purpose of atomizing it in the region of emission at the nozzle 3.

The system of FIG. 1A also includes a remote high voltage electrostatic source 16*a* capable of supplying 50 KV or more and a high voltage cable 16, constructed in accordance with this invention, of a core 16*b* of multiple continuous silicon carbide fibers of the type described in more detail hereafter. Cable 16 is connected at one end to the remote electrostatic supply, and at its other end to an electrically conductive spring 18. To facilitate connection of the continuous silicon carbide fiber core 16*b* of cable 16 to spring 18, a conductive thumb tack 17 is inserted into the core at the end of the cable. Spring 18, to which the core 16*a* is electrically connected via the thumb tack 17, is compressed between the forward end of the high voltage cable 16 and a conventional discrete high voltage resistor 19, preferably having a resistance of 75M ohms. The spring 18 serves to provide a good electrical connection between the forward end of the cable 16 and the rear end of the resistor 19. The forward end 20 of the resistor 19 is connected by means of a small electrical conductor 21 to a spring 22 in contact with a conventional high voltage resistor 30 located in a bore 3*a* in the nozzle 3 as best shown in FIG. 1B. The resistor 30 has a resistance smaller than that of the resistor 19, preferably on the order of approximately 15M ohms. As will be understood by those skilled in the art, the resistance of resistors 19 and 30 can vary depending upon a number of factors including the voltage supplied to the gun from the high voltage source 16*a* via the cable 16.

Referring to FIG. 1B, the nozzle 3 of the gun comprises a fluid cap or nozzle 23, an air nozzle 24, and a retaining nut 25 which are preferably fabricated of electrical nonconductive material, such as a plastic material sold under the Dupont trademark "Delrin". The surface configuration of these components combine to form fluid and air passages in the nozzle 3 which will be described more fully below. The retaining nut 25 is effective to hold the fluid nozzle 23 and air cap 24 into the front end of the barrel 2.

The air conduit 13 in the handle 1 communicates with the air chamber 14 in the nozzle 3. The air chamber 14 is in communication via port 14*a* with air passages 26 in the air cap 24. The air passages 26 terminate in outlet orifices 15 in the air cap 24. The air issuing from the orifices 15 is effective to atomize the coating material being discharged from the fluid nozzle 23. Air chamber 14 also communicates with air passage 14*b* to supply air to fan-shaping air horns 24*a* which shape the atomized material into a desired spray pattern. Centrally located relative to the air cap 24 is an opening 27 through which the forward, fluid-discharging end of the fluid nozzle 23 passes.

The fluid nozzle 23 has a bore 3*a* defining a passage 28 which communicates with a fluid chamber 34 toward its forward end. This chamber 34 is open to a discharge orifice at its forward end. The bore 3*a* and the fluid nozzle 23 are preferably circular in cross section. The high megohm resistor 30 is encased in a sleeve member 29 located in the fluid passage 28 of the fluid nozzle 23. The sleeve member 29 is for chemical and abrasion protection of the resistor 30 and can be made of a material sold under the Dupont trademark "Teflon". The sleeve member 29 is preferably square in cross section, as viewed in a plane perpendicular to the plane of the figure, so as to combine with the circular shape of bore 3*a* to provide the flow path 28 for the coating material between the interior surface of the bore 3*a* and the exterior surface of the sleeve 29, thereby providing for the flow of coating material from the passage 10 in the barrel 2 to the passage 34 and discharge orifice 3*d* of the fluid nozzle 23 at its forward end. The resistor 30 is preferably sealed in the sleeve 29 by means of epoxy.

The forward end 32 of the resistor 30 is electrically connected to a thin stainless steel wire electrode 33 extending through the fluid chamber 34 and out through the discharge orifice 3*d* of the fluid nozzle 23. Preferably, the electrode 33 is round, having a diameter of approximately 0.06 cm and a length of approximately 1.75 cm. The electrode 33 protrudes beyond the end of the fluid nozzle 23 by approximately 0.6 cm.

The resistors 19 and 30 incorporated in the preferred embodiment of FIGS. 1A and 1B are commercially available. The value of the resistors 19 and 30 will depend upon various factors. In an actual device designed for operation in the range of 65–76 KV or more (open circuit voltage), the resistor 19 in the barrel 2 is 75M ohms, and the resistor 30 and the nozzle 3 is 12M ohms. In general, the resistance of resistor 19 must be great enough to "damp" the accumulated effects of capacitively stored electrical energy upstream of the rear end of the resistor 19 due to the spring 18, cable 16, etc. The value of the resistor 30 in the nozzle 3 must be great enough to "damp" out the effects of electrical energy capacitively stored in the components, such as conductor 21 and spring 22, between the resistor 19 in the barrel and the resistor 30 in the nozzle 3. The desired value of gun resistance, i.e., the series resistance of the two series-connected discrete resistors, can be selected by ignition tests well known to those skilled in the electrostatic spray coating art.

The cable 16 of the preferred embodiment depicted in FIGS. 1A and 1B, considered in more detail, includes a centrally located core of plural continuous silicon carbide fibers exhibiting physical and electrical properties of the general type exhibited by the fibers constructed in accordance with the teachings of Yajima et al U.S. Pat. No. 4,100,233, issued July 11, 1978, assigned to The Research Institute For Iron, Steel and Metals of The Tohoku University, Sendai, Japan. The entire disclosure of U.S. Pat. No. 4,100,233, as well as the following publications of Nippon Carbon Co., Ltd., Tokyo, Japan, available from Dow Corning, Midland, Mich., are incorporated herein by reference:

NICALON Silicon Carbide Fiber, 12 pages; and Industrialization of Silicon Carbide Fiber and its Applications, by Jun-ishi Tanaka, Executive Director, Nippon Carbon Co., Ltd., 11 pages.

Fibers in accordance with the foregoing patents and publications are marketed under the trade name NICALON by Nippon Carbon Co., Ltd., Tokyo, Japan, and Dow Corning, Midland, Mich.

In accordance with one known process, continuous silicon carbide fibers are produced by a method which includes the following steps:

1. subjecting at least one organosilicon compound selected from (1) a compound having only Si-C bond, (2) a compound having Si-H bond other than Si-C bond, (3) a compound having Si-Hal bond, (4) a compound having Si-N bond, (5) a compound having Si-OR bond, (7) a compound having Si-Si bond, (8) a compound having Si-O Si bond, (9) an ester of organosilicon compound, and (10) an oxide of organosilicon compound, to polycondensation to produce organosilicon high molecular weight compounds, in which silicon and carbon are the main skeleton components, 2. reducing the content of low molecular weight compounds mixed together with said high molecular weight compound by treating the mixture to produce the organosilicon high molecular weight compound having a softening point of higher than 50° C., 3. preparing a spinning solution from the thus treated organosilicon high molecular weight compound and spinning said solution into fibers, 4. heating the spun fibers at a temperature of 50°–400° C. under an oxidizing atmosphere to form an oxide layer on the filament surface, 5. preliminarily heating the spun fibers at a temperature of 350°–800° C. under a non-oxidizing atmosphere to volatilize the remaining low molecular weight compounds, and 6. baking the thus treated fibers at a temperature of 800°–2,000° C. under vacuum or at least one non-oxidizing atmosphere selected from the group consisting of an inert gas, CO gas and hydrogen gas.

In a preferred form of this method, the mixture of low molecular weight and high molecular weight compounds is treated with a solvent, such as alcohol or acetone, to preferentially dissolve the low molecular weight compounds.

NICALON continuous silicon carbide fiber, in one commercially available form, is physically characterized as follows:

Filament Diameter: 10–15 microns,
Cross Section: round,
Density: 0.093 pounds/inch$^3$ (2.55 g/cm$^3$),
Tensile Strength: 360–470 ksi (250–300 kg/mm$^2$),
Tensile Modulus: 26–29$\times 10^3$ ksi (18–20$\times 10^3$ kg/mm$^2$), and
Coefficient of Thermal Expansion (parallel to fiber): $3.1\times 10^{-6}$/° C.

The specific resistivity of NICALON silicon carbide fiber which is uniform throughout the fiber and independent of fiber flexure, can be varied by heat treating the fiber at different temperatures subsequent to spinning. The variation in specific resistivity as a function of heat treating temperature, which is shown in FIG. 7, can be seen to vary by a factor of approximately $10^4$ for approximately $10^2$ ohm-cm. to $10^6$ ohm-cm.

The NICALON continuous silicon carbide fibers can be formed into yarn, and are commercially available in 500-fiber yarn strands. The total area of the 500-fiber yarn is $2.25\times 10^{-4}$ cm.$^2$ for fibers having an average diameter of 11 microns. A cable of 8 meter length constructed of four 500-fiber yarn strands of the foregoing type, with each 500-fiber yarn strand being 8 meters in length and the four yarn strands being connected in parallel circuit arrangement, provides a total resistance measured between the opposite ends thereof of approximately 200M ohms when the resistivity of the continuous silicon carbide fiber material is $0.8\times 10^3$ ohm-cm. A single 500-fiber strand of NICALON continuous silicon carbide fiber yarn has a resistance per lineal meter of 2.5M ohms when the silicon carbide fibers have a resistivity of $1.0\times 10^3$ ohm-cm. and a total fiber area of $2.25\times 10^{-4}$cm.

While the diameter of the silicon carbide fiber can vary depending upon the flexibility desired, a diameter in the range of 10–15 microns is commercially available and has been found satisfactory for the construction of high voltage cables for electrostatic spray coating applications. If fiber diameter is too small it becomes too fragile for convenient handling without breaking. If the fiber diameter is too large, it is too stiff for convenient use.

For use as resistive elements, either cable or discrete resistors, in the high voltage path between the charging electrode and the high voltage electrostatic power supply of an electrostatic spray coating system, the specific resistivity of the silicon carbide fibers is preferably in the approximate range of $2\times 10^2$–$15\times 10^2$ ohm-cm However, as noted, the resistivity can vary in the approximate range of $10^2$–$10^6$ ohm-cm. Assuming a given total resistance R is desired, and the fiber length L is known, depending upon the specific resistivity r of the fibers, the total or collective cross-sectional area A of the plural parallel-connected fibers is varied to achieve the desired total resistance R in accordance with the well known formula $R=r\ L/A$. Knowing the desired total cross-sectional area A of the cable or resistor, the number N of fibers is selected depending on the diameter of the individual fibers.

In practice, it has been found desirable to provide the cable 16 which interconnects the resistor 19 and the remote high voltage power supply 16*a* with a total resistance of approximately 200M ohms, plus or minus 50M ohms, depending upon the magnitude of the electrostatic voltage being used, etc. For high voltage cable lengths of 8 meters, 12 meters, and 16 meters, the cable preferably has a resistance per lineal meter of approximately 40M ohms, 25M ohms, and 12.5M ohms, respectively.

In practice, the number N of parallel-connected fibers could conceivably vary in the approximate range of $10^2$–$10^4$, although a range for N of 500–4000 is more likely. In one preferred embodiment, an 8 meter cable operating at 200 KV, using 11 micron diameter fiber strands having a specific resistivity of $1\times10^3$ ohm-cm., is constructed of four strands of 500-fiber yarn connected in parallel to provide a total fiber count N of 2000.

While a total resistance R of 200M ohms, with a variance of ± 50M ohms, is customary for cables ranging in length from 5M–16M, the total cable resistance R could vary in the approximate range of 1M ohm–1000M ohms depending on the magnitude of the electrostatic voltage, electrical current level through the cable, and length of the cable. A range of 10M ohms–400M ohms for total cable resistance R is more likely to be encountered, however.

Depending on the total resistance desired for a cable and the resistivity and length of the fibers, the total or collective diameter of the fibers can vary in the approximate range of $1\times10^{-2}$cm. –1cm. However, a total fiber diameter in the range of $3.16\times10^{-2}$cm. to $8.65\times10^{-2}$cm. is preferred. If the total fiber diameter is too large the cable is unduly stiff and bulky, as well as too expensive by reason of the substantial mass of fiber material required.

The high voltage cable 16 containing the silicon carbide fiber core is provided with an insulative sheath designed to safely withstand the operating voltage at which the cable is utilized. At operating voltages of 115 KV, insulative sheaths fabricated of polyethylene with a resistivity of $10^{17}$ ohm-cm. and having a wall thickness measured in a radial direction of approximately 0.35 cm. have been found satisfactory. Other known insulative materials suitable for high voltage operation may be used. To facilitate extruding the insulative sheath over the silicon carbide fiber core, a protective reinforcing fabric sheath constructed of Dacron (Dupont trademark) fabric may be provided. The Dacron fabric sheath enables the silicon carbide fiber core to be pulled through the polyethylene extruder without damage.

Cable lengths of anywhere from approximately 1 m to 50 m or more can be used. However, lengths of 2 m–32 m are more often used, with lengths of 4 m–16 m being the most common.

While the spray coating device G shown in FIG. 1A is a hand-held gun of the air atomization type, it will be understood by those skilled in the art that the invention is equally useful with automatic guns which are not hand-held, but which are mounted to stationary and/or machine-reciprocated supports and remotely activated. Those skilled in the art will also understand that the invention is not limited to spray devices utilizing air atomization, but are equally useful with hydraulic, or airless, atomization spray devices, either hand-held or automatic. Additionally, the preferred embodiment shown in FIG. 1A electrostatically charges the coating via a corona discharge mechanism. Those skilled in the art will understand that the invention is not limited to corona charging, but is also useful in conjunction with coating charging electrodes which charge the coating material utilizing contact charging techniques, inductive charging techniques, and/or in conjunction with repelling electrodes which direct electrostatically charged paint in a direction away from the repelling electrode. The principles of this invention are also applicable to electrostatic spray coating where atomization of the coating material is effected through rotary atomization techniques utilizing a rotating electrode mounted to the atomizing member and/or a stationary electrode mounted in charging relationship to the conductive coating. Also, the invention is useful in systems for electrostatic spray coating of powders as well as atomized liquids.

Figure 2:
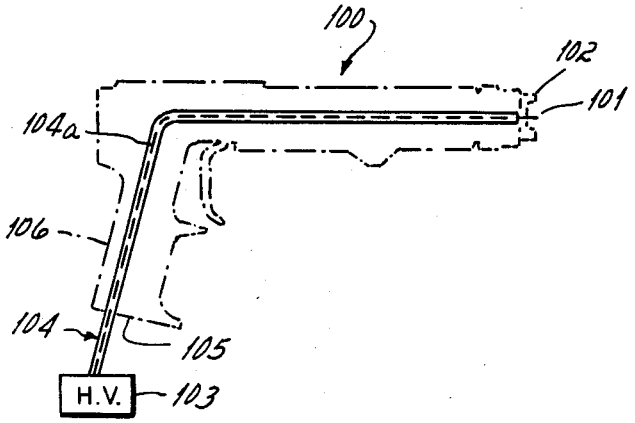
FIG. 2 is a schematic view of an air and/or hydraulic atomization gun schematically illustrating a continuous silicon carbide fiber cable of this invention interconnecting the gun-mounted charging electrode and a remote high voltage electrostatic supply.

FIG. 2 depicts another embodiment of the invention incorporating an electrostatic spray gun 100 having a charging electrode 101 proximate the gun nozzle 102 whereat the coating material is emitted. In accordance with the embodiment depicted in FIG. 2, high voltage electrostatic potential is supplied to the electrode 101 from a remotely located high voltage electrostatic supply 103 via an insulated cable 104 having a continuous silicon carbide fiber core of this invention which is designated 104*a*. The portion of the cable core 104*a* between the high voltage supply 103 and the lower end 105 of the gun handle 106 has a nominal resistance of approximately 200M ohms. The portion of the cable core 104*a* in the gun 100 between the lower end 105 of the handle 106 and the electrode 101 at the nozzle 102 has a total resistance of approximately 90M ohms corresponding to the combined resistance of discrete conventional high voltage resistors 19 and 30 of the embodiment depicted in FIGS. 1A and 1B. Thus, in the embodiment depicted in FIG. 2, the entire electrical path between the remote high voltage electrostatic supply 103 and the electrode 101 is in the form of an insulated cable 104 having a continuous silicon carbide fiber core 104*a* in accordance with the principles of this invention. The continuous silicon carbide fiber core 104*a* has uniform characteristics (e.g., diameter and resistivity) along its length and is constructed, depending on the specific resistivity, length, number, and diameter of the strands, to provide the total resistance between source 103 and electrode 101 which is desired. Alternatively, the cable and gun resistance could incorporate silicon carbide fibers having different properties, such as, diameter, resistivity, number of filaments, etc. For example, the silicon carbide fibers in the cable could have a higher resistivity and smaller diameter than that of the silicon carbide fibers in the gun resistor to provide greater flexibility for the cable than for the gun resistor.

Figure 3:
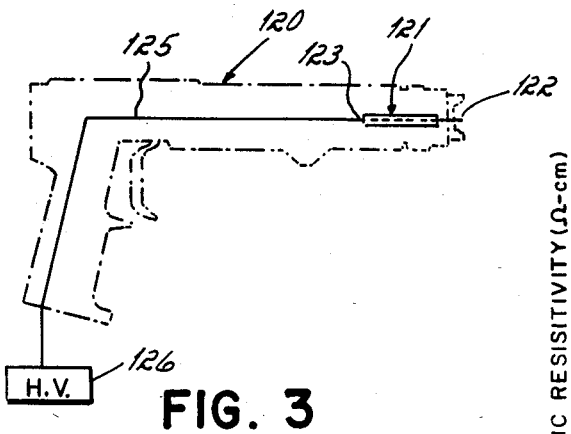
FIG. 3 is a schematic view of an air and/or hydraulic atomization gun schematically illustrating a continuous silicon carbide fiber resistor of this invention in the gun between the electrode and a conventional high voltage cable which connects to a remote high voltage electrostatic supply.

In FIG. 3, an electrostatic spray coating gun 120 is schematically shown having a resistor 121 incorporated in the gun between the electrode 122 and the forward end 123 of a conventional discrete resistor high voltage electric cable 125. The other end of the high voltage cable 125 is connected to a high voltage electrostatic supply 126. The resistor 121 is fabricated from a plurality of parallel-connected silicon carbide fiber strands which, depending upon the specific resistivity and diameter thereof, are sufficient in number and length to provide the desired total resistance, which preferably is in the range of 75–100M ohms.

Figure 4:
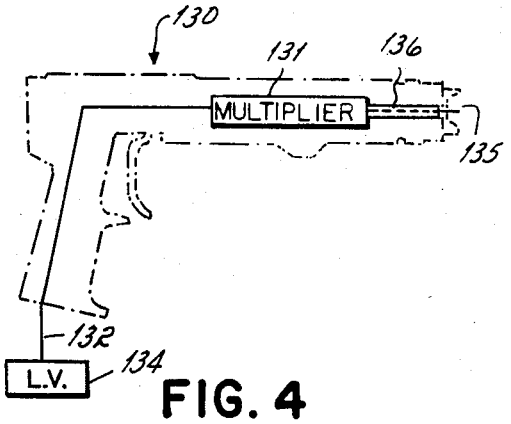
FIG. 4 is a schematic view of an air atomization and/or hydraulic atomization gun schematically illustrating a continuous silicon carbide fiber resistor of this invention incorporated in the gun between the electrode and a high voltage electrostatic supply also incorporated in the gun which connects to a remote source of low voltage via a low voltage cable.

With reference to FIG. 4, in accordance with another embodiment of this invention, an electrostatic spray gun 130 is depicted which incorporates a voltage multiplier 131 of the type which converts low AC voltage to high DC voltage. The multiplier 131 may be of the type disclosed in Senay U.S. Pat. No. 3,731,145, which is known as Cockcroft-Walton generator, and which consists of a cascade of series-connected diode/capacitor voltage doubling stages. A low voltage cable 132 is connected between a remote low voltage supply 134 and the input end of the multiplier 131. Connected between the output end of the multiplier 131 and the electrode 135 is a resistor 136 constructed of continuous silicon carbide fibers in accordance with this invention. The resistor 136 may be constructed and have a total resistance as described in connection with resistor 121 incorporated in the gun of FIG. 3.

FIG. 5, in accordance with another embodiment of this invention, depicts an electrostatic spray gun 140 which also incorporates a voltage multiplier 141 of the general type described in connection with voltage multiplier 131 of FIG. 4. The low AC voltage input to the multiplier 141 via electrical conductor 142 is provided by an air-driven turbo-electric generator 143 which is also mounted in the gun. The supply air to the turbo-electric generator 143 is provided from a remote pressurized air source 144 via an air hose 145. Interconnected between the output end of the multiplier 141 and the electrode 147 is a resistor 148 fabricated of continuous silicon carbide fibers in accordance with this invention. The resistor 148 is constructed and has a resistance as described in connection with resistor 121 incorporated in the gun of FIG. 3.

FIG. 6 depicts another embodiment of the invention having an electrostatic coating device 150 of the rotary atomization type. The device 150 includes an insulative cup-shaped rotary atomizer 151. The atomizing element 151 is rotated by a motor-driven shaft 152 to which the atomizing element 151 is connected. A source of liquid coating material (not shown) supplies paint or like liquid coating via a tube 153 to a rearwardly projecting extension **154*b* of the rotating atomizing element 151. The paint is fed to the interior surface 155 of the cup 151 via passages 154 formed in the rear wall 154*a* of the atomizing element 151 to which the end of the shaft 152** is connected.

As the cup 151 rotates, the liquid paint advances under centrifugal force in a forward and outward direction to the leading edge 157 of the atomizing cup whereat it is centrifugally atomized as indicated by reference numeral 159. Embedded in the inner surface 155 of the atomizing cup 151 proximate the atomizing edge 157 is a circular ring-shaped electrode 158 fabricated of continuous silicon carbide fibers of this invention. High voltage electrostatic potential is supplied to the ring electrode 158 via a network of silicon carbide fiber conductors 160 which are each disposed longitudinally on the exterior surface of the cup 151 circumferentially spaced from each other. The forward ends of the conductors 160 connect to the ring electrode 158 via short silicon carbide fiber conductors 161 which are located in transverse passages formed in the wall of the atomizing cup 151 outboard of the ring 158. The inner ends of the conductors 160 are connected in common to a circular conductor 163 of continuous silicon carbon fibers mounted on the outer surface of the insulative cup 151. The circular conductor 163 and network of individual longitudinal conductors 160, as well as the ring electrode 158 and the transverse conductors 161, all rotate with the insulative atomizing cup 151.

To transfer high voltage electrostatic energy to the circular conductor 163, a stationary electrode 164 is provided which is spaced very slightly from the rotating conductive ring 163. The electrode 164 is connected to a high voltage electrostatic supply (not shown) located remote relative to the spray device 150, or alternatively to a high voltage electrostatic supply (not shown) mounted in the spray device 150, via a silicon carbide fiber core cable 166. The electrode 164 may be a stainless steel needle inserted into the continuous silicon carbide fiber core of the insulated cable 166. Electrode 164 and ring conductor 163 function as a "non-contacting wiper". The cable 166, circular conductor 163, longitudinal conductors 160, transverse conductors 161, and the ring-shaped electrode 151 are constructed such that, depending upon fiber resistivity and cross section and the respective length and number of the fibers, they collectively provide a total resistance which facilitates hazard-free electrostatic charging of the atomized paint particles at edge 157 when the cable 164 is energized from an electrostatic voltage supply of suitable potential in excess of 50 KV.

FIG. 8 depicts, extending from a spray device nozzle 170, an electrode 173 composed of a continuous silicon carbide fiber core 171 which is reinforced with a thin sheath 172 of electrically conductive resin for providing structural rigidity. The electrode core 171 is connected to a high voltage electrostatic supply via an insulated silicon carbide cable 174 in accordance with any one of the arrangements depicted in FIGS. 2–5. Thus, in the embodiment of FIG. 8 the continuous silicon carbide fibers of this invention are incorporated in the coating charging electrode itself.

In a preferred form of cable construction shown in FIG. 9, three strands of 1100 denier Dacron (Dupont trademark) polyester are twisted with four 500-filament strands of Nicalon, with the twisting being such that there is a full twist every 1.25 cm. of length of the Nicalon strands. The Dacron strands reinforce the Nicalon strands to facilitate pulling the Nicalon strands through an extruder. Surrounding the twisted strands 200 of Dacron and Nicalon is an extruded layer of 13% carbon-filled polypropylene 202 having a resistivity in the approximate range of $10^7$–$10^9$ ohm-cm. The diameter of the carbon filled polypropylene 202 is in the approximate range of 0.14–0.16 cm.

The function of the carbon-filled polypropylene layer 202 is to avoid large voltage gradients at the location of a broken silicon carbide filament should a silicon carbon filament break somewhere along the length of the cable. At the location of the broken silicon carbide filament the broken end 203 of the filament may project radially outwardly from the twisted Dacron and silicon carbide filament core 200. In view of the extremely small diameter of a silicon carbide filament, the broken end 203 of the silicon carbide filament creates very high voltage gradients. By imbedding the outwardly projecting end 203 of the broken silicon carbide filament in the relatively highly resistive layer 202, the high voltage gradients that would otherwise tend to occur are markedly reduced. This, in turn, reduces the tendency of the dielectric sheath used to insulate the core 200 for high voltage operation, such as a sheath 204, to prematurely fail at the site of the end of the broken silicon carbide filament. The layer 202 has a resistance value intermediate between the core 200 and the sheath 204.

The dielectric sheath 204 is preferably fabricated of Alathon (Dupont trademark) 3535 NC10, which is a high molecular, low density polyethylene. Typically the polyethylene dielectric layer 204 is extruded in four passes. The first pass extrudes the polyethylene to a diameter of 0.30 cm. The three remaining extruding passes are of equal thickness, providing a total diameter for the polyethylene sheath 204 in the approximate range of 0.79–0.81 cm. Surrounding the dielectric sheath 204 is an electrically grounded conductive braid 206 having a diameter of 0.87 cm. Surrounding the conductive braid 206 is a two-mil thick layer of Mylar (trademark) polyester sheet material 208 wrapped to provide a 50% lap. The Mylar layer 208 is provided with a layer of polyurethane 210 having a diameter in the approximate range of 1.06–1.08 cm.

While the invention has been described in connection with certain presently preferred embodiments, those skilled in the art will recognize many modifications of structure, arrangements, portions, elements, materials and components can be made in the practice of this invention without departing from the principles thereof.

What is claimed is:

1. An electrically insulated high voltage cable of predetermined length measured between opposite ends thereof for conducting electrostatic voltages in excess of approximately 50 KV to a coating-charging electrode in an electrostatic spray coating system, comprising:

a plurality of substantially equal length continuous silicon carbide fibers electrically connected primarily in parallel, said fibers each having a length in the approximate range of 1 m–50 m and extending between opposite ends of the cable to provide electrical current flow paths primarily substantially longitudinally along the length of said cable, said plurality of parallel-connected fibers collectively having a diameter measured generally transversely to the length of the cable in the approximate range of $10^{-2}$ cm.–1 cm. and a specific resistivity selected to provide a total resistance measured between the opposite ends of the cable in the approximate range of 1M–1000M ohms, and an insulative sheath surrounding said parallel-connected fibers having a wall thickness and dielectric strength to avoid dialectric breakdown when said cable is connected to an electrostatic voltage supply in excess of approximately 50 KV.

2. The cable of claim 1 wherein said fibers each have an average diameter in the approximate range of 0.1 micron–100 microns.

3. The cable of claim 1 wherein said fibers each have an average diameter in the approximate range of 1 micron–25 microns.

4. The cable of claim 1 wherein said fibers each have an average diameter of approximately 10 microns.

5. The cable of claim 1 wherein the specific resistivity of said fibers is in the approximate range of $10^2$ ohm-cm–$10^4$ ohm-cm.

6. The cable of claim 1 wherein the specific resistivity of said fibers is in the approximate range of $2\times10^2$ ohm-cm.–$15\times10^2$ ohm-cm.

7. The cable of claim 1 wherein the specific resistivity of said fibers is approximately $10^3$ ohm-cm.

8. The cable of claim 1 wherein said parallel-connected fibers collectively have a total cross-sectional area in the approximate range of $10^{-5}$ cm.$^2$–$10^{-1}$ cm.$^2$.

9. The cable of claim 1 wherein the fiber length is in the approximate range of 2 m–32 m.

10. The cable of claim 1 wherein the fiber length is in the approximate range of 4 m–16 m.

11. The cable of claim 1 wherein said parallel-connected fibers collectively have a cross-sectional area of approximately $3\times10^{-3}$ cm.$^2$.

12. The cable of claim 1 wherein said parallel-connected fibers collectively have a cross-sectional area in the approximate range of $1\times10^{-3}$ cm.$^2$–$6\times10^{-3}$ cm.$^2$.

13. The cable of claim 1 wherein said parallel-connected fibers collectively have a cross-sectional area in the approximate range of $10^{-4}$ cm.$^2$–$10^{-2}$ cm.$^2$.

14. The cable of claim 1 wherein the number of fibers is approximately 2000.

15. The cable of claim 1 wherein the number of fibers is in the approximate range of $10^2$–$10^5$.

16. The cable of claim 1 wherein the number of fibers is in the approximate range of $10^3$–$10^4$.

17. An electrically insulated high voltage cable of predetermined length measured between opposite ends thereof for conducting electrostatic voltages in excess of approximately 50 KV to a coating-charging electrode in an electrostatic spray coating system, comprising:

a plurality of substantially equal length continuous silicon carbide fibers electrically connected primarily in parallel, said fibers extending between opposite ends of the cable to provide electrical current flow paths primarily substantially longitudinally along the length of said cable, said plurality of parallel-connected fibers collectively having a total diameter measured generally transversely to the length of the cable and a resistivity selected to provide a total resistance measured between the opposite ends of the cable in the approximate range of 1M ohms–100M ohms per lineal meter of cable, and an insulative sheath surrounding said parallel-connected fibers having a wall thickness and dielectric strength to avoid dialectric breakdown when said cable is connected to an electrostatic voltage supply in excess of approximately 50 KV.

18. The high voltage cable of claim 17 wherein said total resistance is in the approximate range of 5M ohms–65M ohms per lineal meter of cable.

19. The high voltage cable of claim 17 wherein said total resistance is in the approximate range of 10M ohms–40M ohms per lineal meter of cable.

20. An electrostatic spray coating system comprising:

a high voltages electrostatic supply for providing electrostatic voltages in excess of 50 KV, a spray device for emitting coating particles toward an article to be coated, an electrode mounted to the spray device in charging relationship to coating particles emitted by the spray device, an electrical path interconnecting the high voltage supply and the electrode composed of a plurality of continuous silicon carbide fibers electrically connected primarily in parallel and disposed along said electrical path to provide electrical current flow paths primarily substantially longitudinally between said electrode and high voltage supply each said fiber having a length in the approximate range of 1 m–50 m, said fibers collectively having a total diameter measured generally transversely to said path in the approximate range of $10^{-2}$ cm.–1 cm. and a specific resistivity selected to provide a total resistance between said electrode and high voltage supply in the approximate range of 1M–1000M ohms.

21. An electrostatic spray coating system comprising:

a spray device for emitting coating particles toward an article to be coated, an electrode mounted to the spray device in charging relationship to coating particles emitted by the spray device, a high voltage electrostatic supply located remote from said spray device for providing electrostatic voltages in excess of 50 KV, a first high voltage path terminating at opposite ends interconnected between the remote high voltage supply and the spray device, said first path composed of a plurality of continuous silicon carbide fibers electrically connected primarily in parallel and extending between said opposite ends of said path to provide electrical current flow paths primarily substantially longitudinally along said first path, each said fiber having a length measured between said opposite first path ends in the approximate range of 1 m–50 m, said fibers collectively having a total diameter measured generally transversely to said first path in the approximate range of $10^{-2}$ cm.–1 cm. and a specific resistivity selected to provide a total resistance measured between the opposite ends of said first path in the approximate range of 1M–(1000–N)M ohms, where N is a number less than 1000, and a second high voltage path in the spray device interconnected between said first path and the electrode, said second path composed a plurality of continuous silicon carbide fibers electrically connected primarily in parallel, disposed between said first path and said electrode to provide electrical current flow paths primarily substantially longitudinally therebetween, and collectively having a total diameter measured generally transversely to said second path in the approximate range of $10^{-2}$ cm.–1 cm. and a length and specific resistivity selected to provide a total resistance between said first path and said electrode in the approximate range of NM ohms.

22. An electrostatic spray coating system comprising:

a spray device for emitting coating particles toward an article to be coated, an electrode mounted to the spray device in charging relationship to coating particles emitted by the spray device, a high voltage electrostatic supply mounted to said spray device for providing electrostatic voltages in excess of 50 KV at a location spaced from the electrode, and an electrical path terminating at opposite ends interconnecting the high voltage supply and the electrode composed of a plurality of continuous silicon carbide fibers electrically connected primarily in parallel and disposed between said opposite ends to provide electrical current flow paths substantially longitudinally along said paths, said fibers having a length measured along said path, a total diameter measured generally transversely to said path, and specific resistivity selected to provide a total resistance between the opposite ends thereof in the approximate range of 1M–1000 ohms.

23. The electrostatic spray coating system of claim 20 wherein the spray device includes a rotary atomizing member with respect to which said electrode is mounted for charging said coating particles atomized thereby, and wherein the electrode is composed of continuous silicon carbide fibers.

24. The electrostatic spray coating system of claim 23 wherein the atomizing member has an edge whereat atomization of coating particles occurs and a flow surface over which coating particles flows towards said edge for atomization thereat, and wherein said continuous silicon carbide fiber electrode is ring-shaped and mounted to said atomizing member for rotation therewith in electrostatic charging relationship to said coating.

25. An electrostatic spray assembly comprising:

a spray device for emitting coating particles toward an article to be coated, an electrode mounted to the spray device in charging relationship to coating particles emitted by the spray device, and an electrical path terminating at opposite ends connectable between the electrode and a supply of electrostatic voltage in excess of 50 KV, said path composed of a plurality of continuous silicon carbide fibers electrically connected primarily in parallel and which are disposed between said oppoiste ends to provide electrical current flow paths primarily substntially longitudinally along said path, each said fiber having a length measured along said path in the approximate range of 1 m–50 m, said fibers collectively having a total diameter measured generally transversely to said path in the approximate range of $10^{-2}$ cm.–1 cm. and a specific resistivity selected to provide a total resistance measured between the opposite ends thereof in the approximate range of 1M–1000M ohms.

26. The electrostatic spray assembly of claim 25 wherein the spray device includes a rotary atomizing member with respect to which said electrode is mounted to charge said coating particles, and wherein said electrode is composed of continuous silicon carbide fibers.

27. The electrostatic spray assembly of claim 26 wherein the atomizing member has an edge whereat atomization of coating particles occurs and a flow surface over which liquid coating particles flows toward said edge for atomization thereat, and wherein said continuous silicon carbide fiber electrode is ring-shaped and mounted to said atomizing member for rotation therewith in electrostatic charging relationship to said coating.

28. The system of claim 25 wherein said electrode is fabricated of at least one continuous silicon carbide fiber.

29. An electrostatic spray assembly comprising:

a spray device for emitting coating particles toward an article to be coated, an electrode mounted to the spray device in charging relationship to coating emitted by the spray device, a high voltage electrostatic supply mounted to said spray device for providing electrostatic voltages in excess of 50 KV at a location spaced from the electrode, and an electrical path terminating at opposite ends thereof interconnecting the high voltage supply and the electrode composed of a plurality of substantially equal length continuous silicon carbide fibers electrically connected primarily in parallel, disposed between said opposite ends to provide electrical current flow paths primarily substantially longitudinally along said path, and collectively having a length measured along said path, a diameter measured generally transversely to said path, and a specific resistivity selected to provide a total resistance between the opposite ends thereof in the approximate range of 1M–1000M ohms.

30. A method of conducting high electrostatic voltages in excess of approximately 50 KV from a high voltage electrostatic supply to a coating-charging electrode in an electrostatic spray coating system comprising:

interconnecting between the electrode and the high voltage supply a cable having opposite ends and composed of substantially equal length continuous silicon carbide fibers electrically connected primarily in parallel and disposed along said cable to provide electrical current flow paths primarily substantiallly longitudinally along the length of said cable, said fibers each having a length measured along the length of said cable in the approximate range of 1 m–50 m, said plurality of parallel-connected fibers collectively having a diameter mesured generally transversely to the length of said cable in the approximate range of $10^{-2}$ cm.–1 cm. and a specific resistivity selected to provide a total resistance between said opposite ends of the cable in the approximate range of 1M–1000M ohms, and energizing the fibers with an electrostatic voltage in excess of 50 KV while insulated to avoid dielectric breakdown to cause electrical current to flow along the length of said cable between said electrode and high voltage supply.

31. A method of electrostatic spray coating an article comprising the steps of:

interconnecting between an electrode and a high voltage supply a cable having opposite ends and composed of substantially equal length continuous silicon carbide fibers electrically connected primarily in parallel and disposed along said cable to provide electrical current flow paths primarily substantially longitudinally along the length of said cable, said fibers each having a length measured along the length of said cable in the approximate range of 1 m–50 m, said plurality of parallel-connected fibers collectively having a diameter measured generally transversely to the length of said cable in the approximte range of $10^{-2}$ cm.–1 cm. and a specific resistivity selected fo provide a total resistance between said opposite ends of said cable in the approximate range of 1M–1000M ohms, and energizing the fibers with an electrostatic voltage in excess of 50 KV while insulated to avoid dielectric breakdown to cause electrical current to flow along the length of the cable between the electrode and the high voltage supply, transporting coating material in electrostatic charge transfer relationship to the energized electrode to electrostatically charge the coating material, and directing charged particles of coating material toward an article to the coated while maintaining the article at an electrostatic potential different from that of the electrode.

32. A method of electrostatic spray coating an article with a spray device having a coating-charging electrode, comprising the steps of:

generating in the spray device a high electrostatic voltage at a location spaced from the electrode, applying high voltage to the electrode over a high voltage path between the electrode and the location in the spray device whereat the high electrostatic voltage is generated, the high voltage path including a plurality of substantially equal length continuous silicon carbide fibers electrically connected primarily in parallel and disposed along said high voltage path to provide electrical current flow paths primarily substantially longitudinally therealong, said plurality of parallel-connected fibers having a length measured along said high voltage path, total diameter measured generally transversely to said high voltage path, and a specific resistivity selected to provide a total resistance between the electrode and the said location in the approximate range of 1M–1000M ohms, transporting coating material in electrostatic charging transfer relationship to the energized electrode to electrostatically charge the coating material, and directing charge particles of coating material toward an article to be coated while maintaining the article at an electrostatic potential different from that of the electrode.

33. The method of claims 31 or 32 wherein the transporting step includes transporting coating material to a location proximate the energized electrode and while thereat impinging the coating material with a stream of pressurized gas to atomize the coating material in the vicinity of the energized electrode.

34. The method of claims 31 or 32 wherein the transporting step includes transporting the coating material to a rotating atomizing member proximate the energized electrode.

35. A method of electrostatic spray coating an article with a spray device having a coating-charging electrode, comprising the steps of:

generating a high electrostatic voltage at a remote location spaced from the spray device, applying high voltage to the electrode over a high voltage path between the electrode and the remote location whereat the high voltage is generated, interposing in series-circuit relation in the high voltage path resistive means composed of a plurality of primarily parallel-connected continuous silicon carbide fibers disposed to provide electrical current flow paths primarily substantially longitudinally along said high voltage path, each said fiber having a length measured along said high voltage path in the approximate range of 1 m–50 m, said fibers collectively having a diameter measured perpendicular to aid high voltage path in the approximate range of $10^{-2}$ cm.–1 cm., and said fibers having a specific resisitivity selected to provide a total resistance of said resistive means in the approximate range of 1M–1000M ohms, transporting coating material in electrostatic charge transfer relationship to the energized electrode to electrostatically charge the coating material, and directing charged particles of coating material toward an article to be coated while maintaining the article at an electrostatic potential different from that of the electrode.

36. A method of electrostatic spray coating an article with a spray device having a coating-charging electrode, comprising the steps of:

generating a high electrostatic voltage at a location remote from the spray device, transmitting high voltage from the remote location to the spray device over a first path terminting at opposite ends and composed of a plurality of primarily parallel-connected continuous silicon carbide fibers disposed between said ends to provide electrical current flow paths primarily substantially longitudinally along said first path, each said fiber having a length measured along said first path in the approximate range of 1 m–50 m, a total diameter measured generally transversely to said first path in the approximate range of $10^{-2}$ cm.–1 cm., and a specific resistivity selected to provide a total resistance between opposite ends of said first path in the approximate range of 1M–(1000−N)M ohms, where N is a number less than 1000, transmitting high voltage in the spray device from the first path to the electrode over a second path composed of a plurality of primarily parallel-connected continuous silicon carbide fibers disposed between said first path and said electrode to provide electrical current flow paths primarily substantially longitudinally along said second path, said second path fibers collectively having a total diameter measured generally transversely to said second path in the approximate range of $10^{-2}$ cm.–1 cm., and a length measured along said second path and specific resistivity selected to provide a total resistance between said first path and said electrode in the approximate range of NM ohms, and directing charged particles of coating material toward an article to be coated while maintaining the article at an electrostatic potential different from that of the electrode.

37. The cable of claim 1 wherein the continuous silicon carbide fibers are constructed by a process comprising the steps of:

(1) preparing a spinning solution from at least one organosilicon high molecular weight compound having a softening point of higher than 50° C., in which silicon and carbon are the main skeleton components, and spinning said spinning solution into fibers, (2) preliminarily heating the spun fibers at a temperature of 350°–800° C. under vacuum to volatilize low molecular weight compounds contained therein, and (3) baking the thus treated fibers at a temperature of 800°–2000° C. under vacuum or at least one nonoxidizing atmosphere selected from the group consisting of an inert gas, CO gas and hydrogen gas, to form said silicon carbide fibers.

38. The system of claim 20 wherein the continuous silicon carbide fibers are constructed by a process comprising the steps of:

(1) preparing a spinning solution from at least one organosilicon high molecular weight compound having a softening point of higher than 50° C., in which silicon and carbon are the main skeleton components, and spinning said spinning solution into fibers, (2) preliminarily heating the spun fibers at a temperature of 350°–800° C. under vacuum to volatilize low molecular weight compounds contained therein, and (3) baking the thus treated fibers at a temperature of 800°–2,000° C. under vacuum or at least one nonoxidizing atmosphere selected from the group consisting of an inert gas, CO gas and hydrogen gas, to form said silicon carbide fibers.

39. The high voltage cable of claim 1 further including an intermediate sheath located between said silicon carbide fibers and said insulative sheath, said intermediate sheath having a resistivity in the approximate range of $10^7$–$10^9$ ohm-cm. to provide resistance intermediate said fibers and insulative sheath.

40. The high voltage cable of claim 39 wherein said intermediate sheath comprises carbon-filled polypropylene.

41. The spray coating system of claim 20 further including:

an insulative sheath surrounding said parallel-connected fibers having a wall thickness and dielectric strength to avoid dialectric breakdown when said cable is connected to an electrostatic voltage supply in excess of approximately 50 KV, and an intermediate sheath located between said silicon carbide fibers and said insulative sheath, said intermediate sheath having a resistivity in the approximate range of $10^7$–$10^9$ ohm-cm. to provide resistance intermediate said fibers and insulative sheath.

42. The spray coating system of claim 41 wherein said intermediate sheath comprises carbon-filled polypropylene.

43. A composite electrically resistive cable assembly having a length disposed between opposite ends thereof, comprising in combination:

a fibrous electrically resistive core disposed along the length of said cable to provide electrical current flow paths primarily substantially longitudinally therealong, said core consisting substantially of silicon carbide; and an electrically insulating jacket surrounding and enveloping said silicon carbide core.

44. The composite electrically resistive cable assembly of claim 43 wherein said core is constructed of a plurality of filaments consisting substantially of silicon carbide.

45. The cable assembly of claim 44 wherein the specific resistivity of said filaments is in the approximate range of $10^2$ ohm-cm to $10^4$ ohm-cm.

46. An electrical cable assembly for transmitting electrostatic voltage from an electrostatic power supply to an electrostatic spray coating device, comprising in combination:

an elongated continuous flexible resistor consisting substantially of silicon carbide fibers disposed to provide electrical current flow paths primariy substantially longitudinally therealong;

an electrically insulating flexible jacket surrounding and enveloping said silicon carbide resistor; and connection means at each end of said flexible resistor for facilitating connection of said flexible resistor between an electrostatic power supply and an electrostatic spray coating device.

47. The cable assembly of claim 46 wherein said silicon carbide fibers have opposite ends connected to said electrical connection means for facilitating the flow of electrical current along the lengths thereof.

48. For use in an electrostatic spray coating system having a high voltage electrostatic supply, the combination comprising:

a resistorized spray coating device for emitting charged coating particles toward an article to be coated;

an electrode mounted to said device in charging relationship to coating particles emitted by said spray device;

a resistive element consisting substantially of silicon carbide fibers disposed to provide electrical current flow paths primarily substantially longitudinally therealong; and electrical connection means electrically connected to said resistive silicon carbide fiber element to facilitate connecting said resistive silicon carbide fiber element in an electrical circuit between said high voltage power supply and said electrode.

49. The combination of claim 48 wherein said silicon carbide fibers have opposite ends connected to said electrical connection means for facilitating the flow of electrical current along the lengths thereof.

50. The combination of claim 49 wherein said resistive element is elongated and provided with a cross-sectional configuration which permits flexure of the resistive element about an axis perpendicular to the direction of its length.

51. An electrostatic spray coating system comprising:

a high voltage electrostatic supply for providing electrostatic voltages in excess of 50 KV;

a spray device for emitting coating particles toward an article to be coated;

an electrode mounted to the spray device in charging relationship to coating particles emitted by the spray device; and a resistive electrical path interconnecting the high voltage supply and the electrode consisting substantially of silicon carbide fibers disposed to provide electrical current flow paths primarily substantially longitudinally therealong.

52. The system of claim 51 wherein said silicon carbide fibers are electrically connected primarily in parallel.

53. An electrostatic spray coating system comprising:

a spray device for emitting coating particles toward an article to be coated;

an electrode mounted to the spray device in charging relationship to coating particles emitted by the spray device;

a high voltage electrostatic supply located remote from said spray device for providing electrostatic voltages in excess of 50 KV;

a first high voltage resistive electrical path interconnected between the remote high voltage supply and the spray device, said first path consisting substantially of flexible silicon carbide filaments electrically connected primarily in parallel and disposed to provide electrical current flow paths primarily substantially longitudinally along the length of said first path; and a second high voltage resistive electrical path interconnected between the first path and the electrode, said second path consisting substantially of at least one silicon carbide filament.

54. The electrostatic spray coating system of claim 53 wherein said filaments of said first and second paths are electrically and structurally continuous therebetween.

55. The electrostatic spray coating system of claim 54 wherein said second path consists substantially of a plurality of silicon carbide filaments electrically connected primarily in parallel.

56. An electrostatic spray coating system comprising:

a spray device for emitting coating particles toward an article to be coated;

an electrode mounted to the spray device in charging relationship to coating particles emitted by the spray device;

a high voltage electrostatic supply mounted to said spray device for providing electrostatic voltages in excess of 50 KV at a location spaced from the electrode; and a resistive electrical path interconnecting the high voltage supply and the electrode consisting substantially of silicon carbide filaments disposed to provide electrical current flow paths primarily substantially longitudinally therealong.

57. The electrostatic spray coating system of claim 56 wherein said path consists substantially of a plurality of silicon carbide filaments electrically connected primarily in parallel.

* * * * *

UNITED STATES PATENT AND TRADEMARK OFFICE

CERTIFICATE OF CORRECTION

PATENT NO. : 4,576,827

DATED : Mar. 18, 1986

INVENTOR(S) : Donald R. Hastings, John Sharpless

It is certified that error appears in the above-identified patent and that said Letters Patent is hereby corrected as shown below:

Column 18, claim 29, line 64, after "coating" insert -- particles --.

Column 19, claim 31, line 68, "the" should be -- be --.

Column 20, claim 35, line 59 "aid" should be -- said --.

Signed and Sealed this

Twenty-fourth Day of February, 1987

*Attest:*

DONALD J. QUIGG

*Attesting Officer* *Commissioner of Patents and Trademarks*